United States Patent [19]

Pike

[11] 4,402,402

[45] Sep. 6, 1983

[54] BARRIER SEAL MULTIPLE-COMPARTMENT PACKAGE

[76] Inventor: Brian R. Pike, 1708 Esplanade, Redondo Beach, Calif. 90277

[21] Appl. No.: 311,406

[22] Filed: Oct. 14, 1981

[51] Int. Cl.[3] ..... B65D 25/08

[52] U.S. Cl. ..... 206/219; 206/221

[58] Field of Search ..... 206/219, 484, 221; 229/56

[56] References Cited

U.S. PATENT DOCUMENTS

| | | | |
|---|---|---|---|
| 2,791,324 | 5/1957 | Knoop et al. | 206/568 |
| 2,874,830 | 2/1959 | Birmingham, Jr. | 206/221 |
| 3,190,499 | 6/1965 | Dow | 206/484 |
| 3,207,420 | 9/1965 | Navorrete-Kindelan | 229/56 |
| 3,608,709 | 9/1971 | Pike | 206/219 |
| 3,720,305 | 3/1973 | Barton | 206/219 |
| 3,847,279 | 11/1974 | Montgomery | 206/219 |
| 3,891,138 | 6/1975 | Glas | 206/219 |

*Primary Examiner*—William T. Dixson, Jr.
*Assistant Examiner*—Brenda J. Ehrhardt
*Attorney, Agent, or Firm*—Charles A. Brown

[57] ABSTRACT

A multiple-compartment package wherein a suitable web or webs having barrier properties for active chemicals is utilized to form a pouch-like multiple-compartment container. The container has the compartments thereof separated by rupturable barrier seals. However, the seals between adjacent compartments do not have the barrier properties of the webs per se from which the package is formed. In order to restrict mixing of migrating chemicals, one or more empty compartments are disposed between those compartments containing the products which are to be mixed.

1 Claim, 2 Drawing Figures

BARRIER SEAL MULTIPLE-COMPARTMENT PACKAGE

This invention relates in general to new and useful improvements in packages of the pouch type, and most particularly to improvements in the multiple-compartment packages wherein two products which are to be mixed are packaged in separate compartments of a single package with a rupturable seal between the compartments wherein when it is desired to mix the two contents of the package, the rupturable seal is ruptured and the two contents are then mixed within the package.

Most particularly, this invention relates to an improvement of the multiple-compartment laminated package of my prior U.S. Pat. No. 3,608,709, granted Sept. 28, 1971.

It will be readily apparent that packages such as that disclosed in my prior U.S. Pat. No. 3,608,709 may be readily made of suitable laminates, including foils, so that migration of active chemicals of the packaged components through the walls of the package is prevented. However, notwithstanding the barrier characteristics of the packaging material, the individual compartments are separated only by a seal between the innermost layers of the web or webs forming the package. These seals, so that they may be readily ruptured, are of a preselected width. Further, it is only economically feasible to make the widths of the barrier seals within a relatively narrow range. Therefore, the barrier seals between adjacent compartments do not have the barrier properties of the laminated material forming the walls of the package. Under these circumstances, the forming of packages in accordance with my prior U.S. Pat. No. 3,608,709 has been restricted to relatively inactive chemicals. If not, the inevitable migration of the active chemicals through or around the barrier seal results in an unscheduled mixing of the packaged materials ruining the entire product.

In accordance with this invention, it has been proposed to solve the problems of my earlier multiple-compartment package by providing at least one empty compartment between the product compartments of the container. Thus any active chemicals which may migrate through the barrier seals will not enter directly into the other compartment containing a product, but into the empty compartment.

With the above, and other objects in view that will hereinafter appear, the nature of the invention will be more clearly understood by reference to the following detailed description, the appended claims and the several views illustrated in the accompanying drawing.

Figure 1:
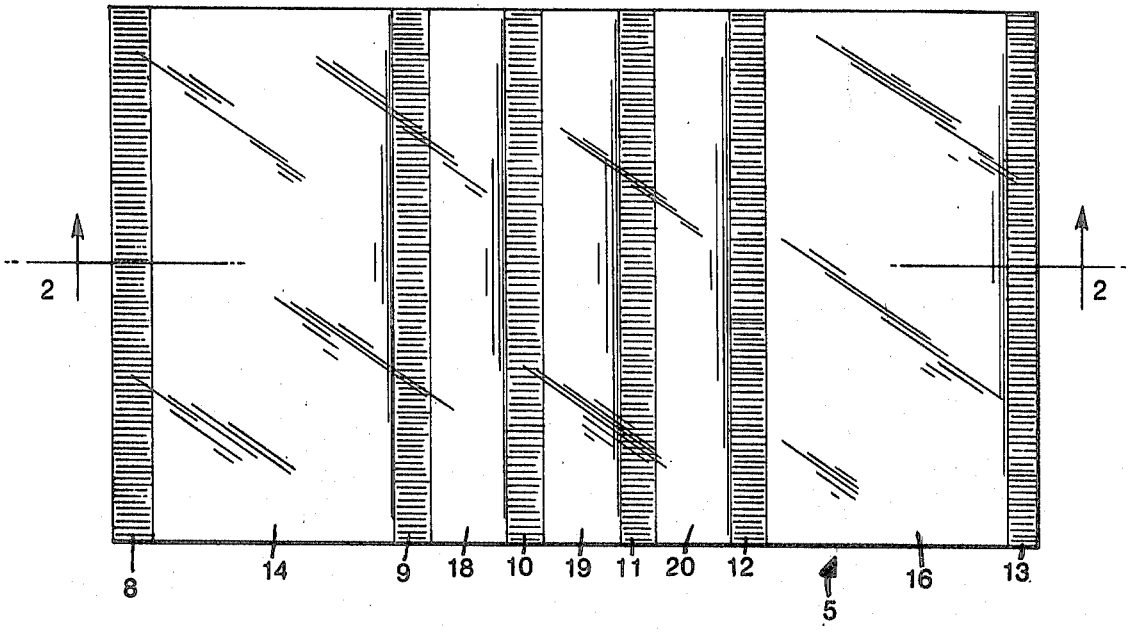
FIG. 1 is a plan view of a multiple-compartment package formed in accordance with my invention.

Referring now to the drawings in detail, it will be seen that there is illustrated a multiple-compartment package formed in accordance with this invention, the package being generally identified by the numeral 5. The package 5 is formed from suitable web stock which is of a laminated construction. Most specifically, two or more webs are laminated to form the web stock. Typical of these webs are films of synthetic plastics, such as cellulose acetate or polyester, known as "Cellophane" and "Mylar", respectively, which are coated on one face with polyethylene. In addition, the laminates may have incorporated therein metal foils, particularly aluminum. The construction of these webs in no way forms a part of my invention.

If desired, two separate webs may be joined together along their edges to form an elongated tube. On the other hand, a single web may be folded to have a longitudinal side seam. Such a tube construction, is flattened, and is cut in predetermined lengths.

Figure 2:
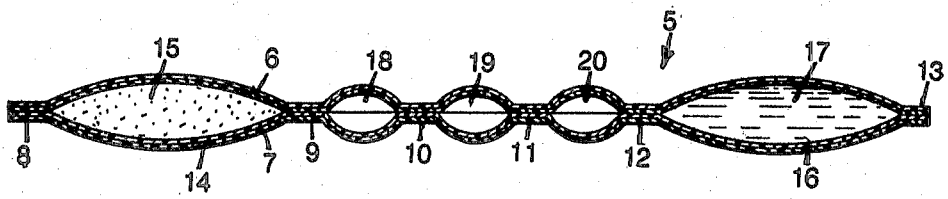
FIG. 2 is a transverse vertical sectional view taken through the package of FIG. 1 substantially along the section line 2—2 and shows the specific construction of a preferred embodiment of my new multiple-compartment package.

With particular reference to FIG. 2, it will be seen that the package 5 has two outer walls 6 and 7 which are bonded together by transversely extending internal seals 8, 9, 10, 11, 12 and 13. Of these seals, at least the seals 9–12 are rupturable seals. It is preferred that the seals 9–12 not be peelable seals, but seals wherein an innermost layer of one of the laminated webs 6, 7 becomes permanently bonded to the other of the innermost layers of the other webs but wherein the one innermost layer is not bonded to other layers of the laminate and when a pull is exerted to separate the webs 6, 7, the innermost layer will rupture on opposite sides of the seal so as to communicate two adjacent compartments.

In accordance with this invention, the seals 8 and 13 are not rupturable.

The seals 8 and 9 define a first product compartment 14 containing a first product 15. In a like manner, the seals 12 and 13 define a second product compartment 16 containing a second product 17 which is to be intermixed with the product 15. The seals 9 and 10 define therebetween a relatively small intermediate compartment 18 which is empty. In a like manner, the seals 10 and 11 define therebetween a relatively small and empty compartment 19. Finally, the seals 11 and 12 define therebetween a third relatively small and empty compartment.

It is to be understood that the web or webs forming the package 5 are formed over a suitable mandrel carrying two different product filling tubes. After the seal 13, for example, has been formed, the product 17 is placed within the lower portion of the tube followed by the formation of the transverse seals 12, 11, 10 and 9 in sequence and in spaced relation. Then the product 15 is placed within the tube, afterwhich the seal 8 is formed. The relatively flattened tube is ready to be severed adjacent seal 8 and between the seal 8 and the next following seal 13.

It will be apparent from a review of the package 5 that the transverse barrier seals 9–12, while they will resist a migration of chemicals, will form no better barrier to such migration than prior seals. However, the active chemicals from the product 15 will flow only initially into the compartment 18 where it is stopped by the seal 10. In a like manner, active chemicals from the product 17 will flow through the barrier seal 12 only into the empty compartment 20. The thus diluted active chemicals normally will not flow through the barrier seals 10 and 11 during a reasonable shelf life for the product. However, if the active, but diluted, chemicals should flow through the barrier seals 10 and 11, they will only intermix within the compartment 19 and only a very slight intermixing will occur. This intermixing should not be sufficient to result in the damaging of the package so that the product packaged therein cannot be used.

From the illustrated embodiment of the invention, it will be seen that only on the order of one half additional material is required to form the multiple-compartment package in accordance with this invention while the resultant pouch or package may be utilized with products containing active chemicals which could not in the past be packaged in this type of package. Further, even with products which could have been packaged in my prior package, the shelf life for such products will be greatly increased.

Although only a preferred embodiment of the package has been specifically illustrated and described herein, it is to be understood that minor variations may be made in the package, including varying the number of empty compartments, without departing from the spirit and scope of the invention as defined by the appended claims.

I claim:

1. A multiple compartment container for separately holding material to be mixed within said container, said container comprising film defining an elongated pouch, and rupturable internal transverse seals defining at least five separate compartments, said compartments include two remote compartments and at least three intermediate compartments, said remote compartments each containing one of two materials to be mixed, and said intermediate compartments being initially empty, said three intermediate compartments including one for each of said remote compartments and forming a receptacle for receiving diluted material migrating from an adjacent remote compartment through that internal seal disposed therebetween, and a central compartment for receiving further diluted material which may migrate from the other of said intermediate compartments through internal seals between said intermediate compartments.

* * * * *